US009102483B2

(12) United States Patent
Osada et al.

(10) Patent No.: US 9,102,483 B2
(45) Date of Patent: Aug. 11, 2015

(54) SHEET CONVEYING APPARATUS AND IMAGE FORMING APPARATUS

(71) Applicant: CANON KABUSHIKI KAISHA, Tokyo (JP)

(72) Inventors: Takehito Osada, Suntou-gun (JP); Minoru Kawanishi, Yokohama (JP); Kenji Watanabe, Suntou-gun (JP); Motohiro Furusawa, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 123 days.

(21) Appl. No.: 13/845,448

(22) Filed: Mar. 18, 2013

(65) Prior Publication Data

US 2013/0213771 A1 Aug. 22, 2013

Related U.S. Application Data

(62) Division of application No. 13/232,188, filed on Sep. 14, 2011.

(30) Foreign Application Priority Data

Oct. 1, 2010 (JP) ..... 2010-224330

(51) Int. Cl.

| | |
|---|---|
| ***B65H 9/04*** | (2006.01) |
| ***B65H 9/00*** | (2006.01) |
| ***B65H 9/14*** | (2006.01) |
| ***B65H 5/06*** | (2006.01) |
| ***B65H 5/26*** | (2006.01) |
| ***B65H 9/06*** | (2006.01) |

(52) U.S. Cl.

CPC ..... *B65H 9/004* (2013.01); *B65H 5/062* (2013.01); *B65H 5/26* (2013.01); *B65H 9/06* (2013.01); *B65H 9/14* (2013.01)

(58) Field of Classification Search

CPC ..... B65H 9/00; B65H 9/004; B65H 9/06; B65H 9/14

USPC ..... 271/242–246, 226

See application file for complete search history.

(56) References Cited

U.S. PATENT DOCUMENTS

| | | | | |
|---|---|---|---|---|
| 4,844,443 | A * | 7/1989 | Trafton | 271/245 |
| 5,240,242 | A | 8/1993 | Ando et al. | |
| 6,011,948 | A * | 1/2000 | Amano et al. | 399/395 |
| 6,527,267 | B1 | 3/2003 | Kuwata et al. | |

(Continued)

FOREIGN PATENT DOCUMENTS

| | | | |
|---|---|---|---|
| JP | 9-183539 | A | 7/1997 |
| JP | 2002-128326 | A | 5/2002 |
| JP | 2006-312543 | A | 11/2006 |

*Primary Examiner* — Prasad Gokhale

(74) *Attorney, Agent, or Firm* — Fitzpatrick, Cella, Harper & Scinto

(57) ABSTRACT

A sheet conveying apparatus including: a conveying roller pair conveying a sheet by a nip portion; a shutter portion which is rotatably supported on a rotary shaft of the first conveying roller; a same radius portion, provided in the shutter portion, which is formed to have substantially the same radius as a radius of the first conveying roller; an abutment portion, provided in the shutter portion, and against which the leading edge of the sheet is abutted; and a boundary portion, provided in a boundary of the abutment portion and the same radius portion, which guides the leading edge of the sheet to the nip portion when the shutter portion is rotated by abutting the leading edge of the sheet against the boundary portion.

6 Claims, 14 Drawing Sheets

(56) References Cited

U.S. PATENT DOCUMENTS

| | | | | |
|---|---|---|---|---|
| 6,643,480 | B2 | 11/2003 | Kuwata et al. | |
| 6,934,505 | B2 * | 8/2005 | Shin | 399/395 |
| 7,971,868 | B2 | 7/2011 | Matsushima et al. | |
| 8,215,637 | B2 * | 7/2012 | Yano | 271/226 |
| 8,387,975 | B2 * | 3/2013 | Suzuki | 271/243 |
| 2007/0126176 | A1 * | 6/2007 | Ha | 271/245 |
| 2008/0093795 | A1 * | 4/2008 | Lee et al. | 271/245 |
| 2011/0018190 | A1 * | 1/2011 | Mandel et al. | 271/109 |

* cited by examiner

SHEET CONVEYING APPARATUS AND IMAGE FORMING APPARATUS

This application is a divisional of U.S. patent application Ser. No. 13/232,188, filed Sep. 14, 2011, currently pending.

BACKGROUND OF THE INVENTION

1. Field of the Invention

The present invention relates to a sheet conveying apparatus and an image forming apparatus including the same.

2. Description of the Related Art

In general, the accuracy of a recording position (hereinafter, also referred to as "recording precision") of an image with respect to a sheet is one of the important factors from the viewpoint of keeping the quality in image formation. In order to enhance the recording precision in an image forming apparatus, when a sheet to be conveyed is skewed, it is necessary to correct the skewed sheet. Therefore, in conventional image forming apparatus, there have been proposed various sheet conveying apparatus having a skew feed correction function so as to enhance the recording precision.

In the sheet conveying apparatus disclosed in Japanese Patent Application Laid-Open No. H09-183539, a plurality of conveying roller pairs are provided in a sheet width direction orthogonal to a sheet conveying direction, and a restraining member that is rotatable about a rotary shaft of the conveying rollers is disposed between the conveying roller pairs. The restraining member has an abutment surface where a sheet abuts. When the leading edge of a sheet abuts against the abutment surface, the sheet slacks due to the reaction force from the abutment portion to form a curved loop. The formation of the loop aligns the leading edge of the sheet in parallel to the sheet width direction orthogonal to the conveying direction to correct a skew. Then, when the restraining member is rotated, the leading edge of the sheet is nipped by a nip portion of the conveying roller pairs while being aligned in parallel to the sheet width direction, and thus the sheet is conveyed. That is, the sheet is conveyed with the skew thereof corrected. By the way, in recent years, there is a demand for an image forming apparatus capable of performing printing to various media. In particular, there is an increasing demand for printing on a sheet with a basis weight smaller than those of the conventional sheets (for example, a sheet of less than 60 g/m$^2$, also referred to as "thin sheet") so as to achieve further resource saving. However, the conventional sheet conveying apparatus as described above may not perform skew feed correction sufficiently with respect to a thin sheet.

For example, in skew feed correction of a thin sheet, by the time when a sheet is nipped by the conveying rollers after abutting against the restraining member, a portion abutting the abutment portion of the restraining member is deformed locally, and the leading edge of the sheet may not be kept straight. As a result, the reaction force from the abutment portion is less transmitted in the conveying direction of the sheet, and the above-mentioned curved loop to be required for correcting the skew of the sheet is hard to be formed, which degrades the precision of skew feed correction. The local undulating state of the leading edge of the sheet is more conspicuous as the basis weight of the sheet is smaller (the stiffness of the sheet is smaller), and the leading edge of the sheet may be bent locally.

SUMMARY OF THE INVENTION

It is an object of the present invention to provide a sheet conveying apparatus capable of correcting the skew of a sheet while suppressing the occurrence of local deformation of the sheet, and provide an image forming apparatus including the sheet conveying apparatus.

The present invention provides a sheet conveying apparatus, including: a conveying roller pair including a first conveying roller and a second conveying roller, which conveys a sheet by a nip portion formed by the first conveying roller and the second conveying roller; a shutter portion which is rotatably supported on a rotary shaft of the first conveying roller, the shutter portion being rotated and guiding a leading edge of the sheet to the nip portion after the leading edge of the sheet conveyed toward the nip portion abuts against the shutter portion on an upstream of the nip portion in a sheet conveying direction for skew feed correction; a same radius portion, provided in the shutter portion, which is formed to have substantially the same radius as a radius of the first conveying roller; an abutment portion, provided in the shutter portion, and against which the leading edge of the sheet is abutted; and a boundary portion, provided in a boundary of the abutment portion and the same radius portion, which guides the leading edge of the sheet to the nip portion when the shutter portion is rotated by abutting the leading edge of the sheet against the boundary portion.

Further, the present invention provides a sheet conveying apparatus, including: a conveying roller pair including a first conveying roller and a second conveying roller, which conveys a sheet by a nip portion formed by the first conveying roller and the second conveying roller; a shutter portion which is rotatably supported on a rotary shaft of the first conveying roller, the shutter portion being rotated and guiding a leading edge of the sheet to the nip portion after the leading edge of the sheet conveying toward the nip portion abuts against the shutter portion on an upstream side of the nip portion in a sheet conveying direction for skew feed correction; an abutment portion, provided in the shutter portion, against which the leading edge of the sheet is abutted; and a guide portion, disposed opposite to the shutter portion, which is formed to have substantially the same radius as a radius of the second conveying roller, and which is formed along a roller surface of the second conveying roller in the nip portion, the guide portion guiding the leading edge of the sheet to the nip portion when the shutter portion is rotated by abutting the leading edge of the sheet against the abutment portion.

According to the present invention, the degradation of precision can be reduced regarding the skew feed correction of a sheet by suppressing the occurrence of local deformation of the sheet.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings. The image forming apparatus according to the embodiments of the present invention is an image forming apparatus having a skew feed correction function capable of correcting the skew of a sheet to be conveyed, such as a copier, a printer, a facsimile machine, and a multi function apparatus thereof. In the following embodiments, the image forming apparatus will be described, taking a laser beam printer 1 as an example.

First Embodiment

Figure 1:
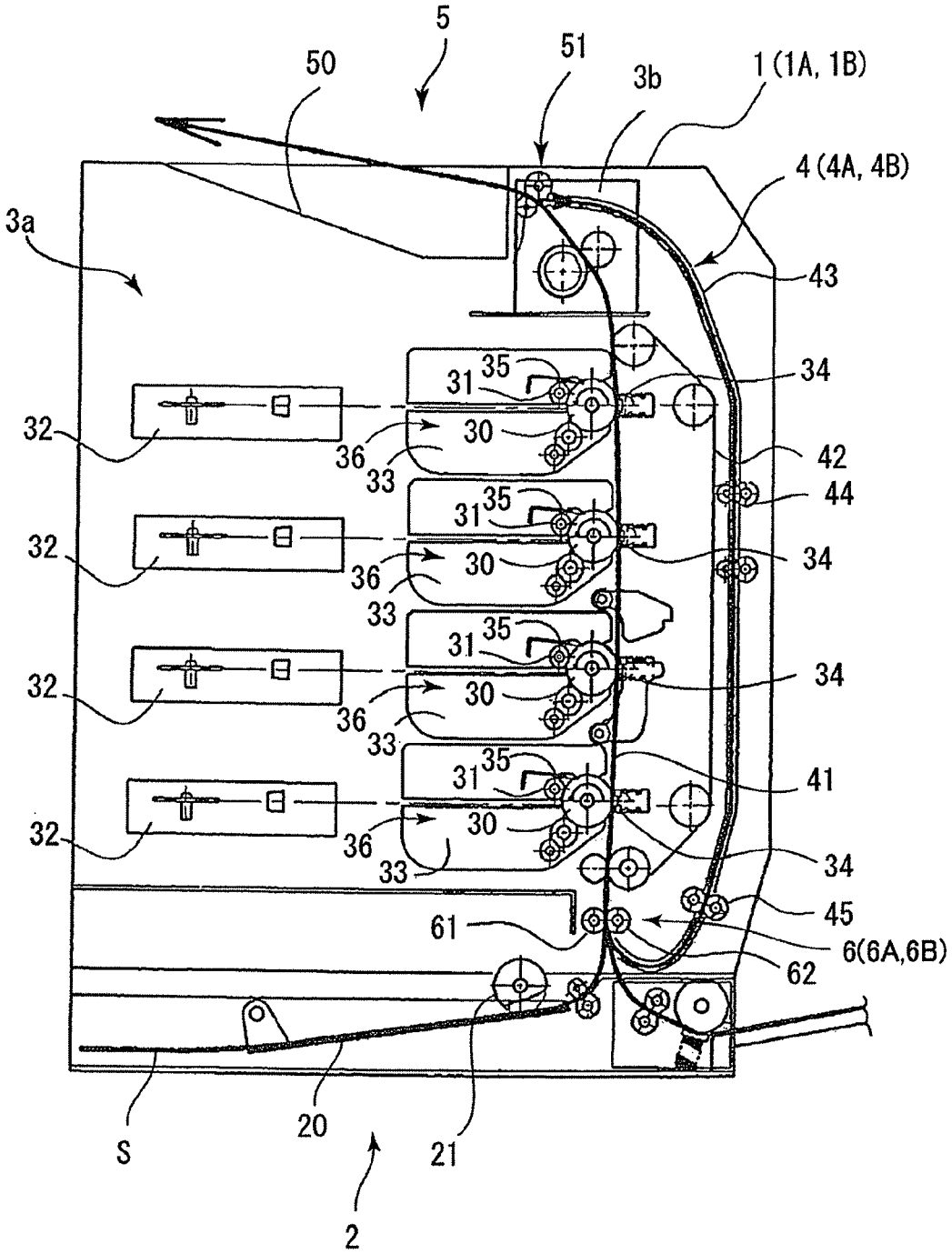
FIG. 1 is a cross-sectional view schematically illustrating an entire structure of a laser beam printer according to a first embodiment of the present invention.

A laser beam printer 1 according to a first embodiment of the present invention will be described with reference to FIGS. 1 to 10. First, the entire structure of the laser beam printer 1 according to the first embodiment will be described with reference to FIG. 1. FIG. 1 is a cross-sectional view schematically illustrating the entire structure of the laser beam printer 1 according to the first embodiment of the present invention.

As illustrated in FIG. 1, the laser beam printer 1 according to the first embodiment includes a sheet feed portion 2 that feeds sheets S, an image forming portion 3*a* that forms an image, and a fixing portion 3*b* that fixes the image. The laser beam printer 1 further includes a sheet conveying portion 4 as a sheet conveying apparatus and a sheet discharge portion 5 that discharges the sheets S with images formed thereon.

The sheet feed portion 2 includes a feed cassette 20 in which the sheets S are contained, a feed roller 21 that feeds the sheets S contained in the feed cassette 20 to the image forming portion 3*a*, and a separation portion (not shown) that separates the sheets S one by one. The sheet feed portion 2 feeds the sheets S contained in the feed cassette 20 to the image forming portion 3*a* by the feed roller 21 while separating the sheets S one by one in the separation portion.

The image forming portion 3*a* forms an image on each of the sheets S based on predetermined image information. The image forming portion 3*a* includes photosensitive drums 30, charging portions 31, exposure portions 32, developing portions 33, transfer rollers 34, and cleaning portions 35.

The photosensitive drum 30 is formed of a metal cylinder having the surface on which a photosensitive layer that is negatively charged is formed. The charging portion 31 uniformly charges the drum surface of the photosensitive drum 30 that is an image bearing member. The exposure portion 32 forms an electrostatic latent image on the photosensitive drum 30 by irradiating the photosensitive drum 30 with a laser beam based on image information. The developing portion 33 allows toner to adhere to the electrostatic latent image to visualize the latent image as a toner image. The transfer roller 34 transfers the toner image on the photosensitive drum 30 to the sheet S. The cleaning portion 35 removes the toner remaining on the surface of the photosensitive drum 30 after the transfer. In this embodiment, the photosensitive drum 30, the charging portion 31, the developing portion 33, and the cleaning portion 35 integrally form a process cartridge portion 36. The fixing portion 3*b* fixes the image by heating the sheet S to which the image has been transferred.

The sheet conveying portion 4 conveys the sheets S with images formed thereon in the image forming portion 3*a*. The sheet conveying portion 4 includes a sheet conveying path 41, a transfer belt 42, a duplex conveying path 43, a skew feed roller pair 44, a U-turn roller pair 45, and a skew feed correcting portion 6.

The sheet conveying path 41 is a conveying path for conveying the sheets S fed from the sheet feed portion 2 or the sheets S conveyed from the duplex conveying path 43. The transfer belt 42 is disposed opposite to the image forming portion 3*a* and transfers an image with the transfer roller 34. The duplex conveying path 43 is a conveying path for conveying the sheet S which has been inverted so as to be subjected to double-sided printing. The skew feed roller pair 44 is provided in the duplex conveying path 43 and conveys the inverted sheet S. The U-turn roller pair 45 is provided in the duplex conveying path 43 and conveys the sheet S conveyed in the duplex conveying path 43 to the sheet conveying path 41 again. The skew feed correcting portion 6 is provided in the sheet conveying path 41, and conveys the sheet S fed or conveyed from the sheet feed portion 2 or the duplex conveying path 43 to the sheet conveying path 41 and performs skew feed correction of the sheet S when the sheet S is fed while being skewed.

The sheet discharge portion 5 includes a discharge portion 50 that discharges the sheets S with images formed thereon and a delivery roller pair 51 that conveys the sheets S with images formed thereon to the discharge portion 50.

The sheet S fed from the sheet feed portion 2 to the sheet conveying path 41 is conveyed to the transfer belt 42 via the skew feed correcting portion 6, and toner images of respective colors are transferred successively in the image forming portion 3*a*. After that, an image is fixed to the sheet S in the fixing portion 3*b* and discharged to the discharge portion 50 by the delivery roller pair 51. Further, in the case of double-sided printing, after the image is fixed to the sheet S in the fixing portion 3*b*, the delivery roller pair 51 is rotated reversely before the sheet S is discharged to the discharge portion 50 by the delivery roller pair 51. Thus, the sheet S with an image formed on one surface thereof is conveyed to the duplex conveying path 43. The sheet S conveyed to the duplex conveying path 43 is conveyed to the skew feed correcting portion 6 via the skew feed roller pair 44 and the U-turn roller pair 45, and corrected for skew feed in the skew feed correcting portion 6 and conveyed again to the image forming portion 3*a*.

Figure 2:
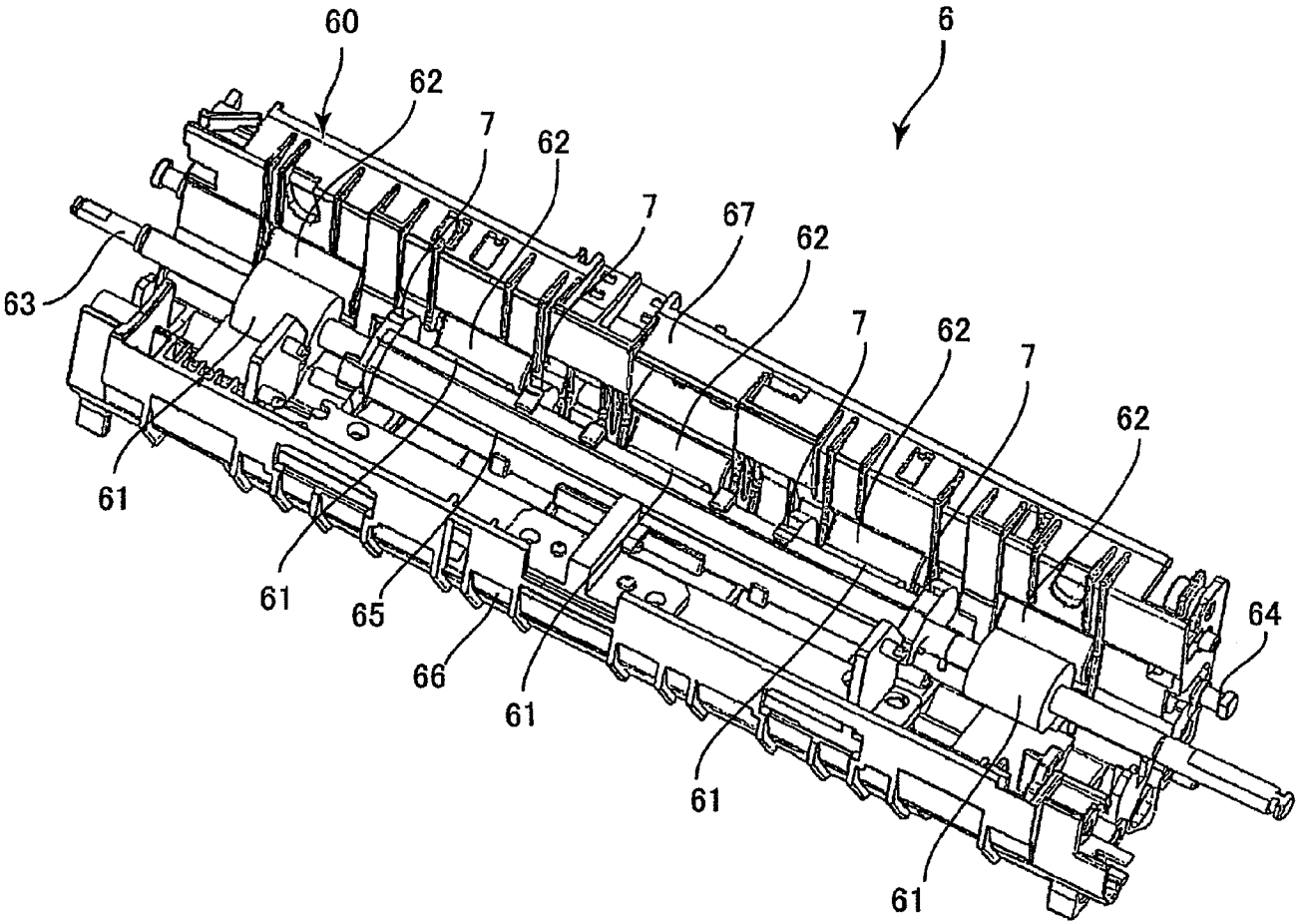
FIG. 2 is a perspective view illustrating an internal structure of a skew feed correcting portion according to the first embodiment.
Figure 3A:
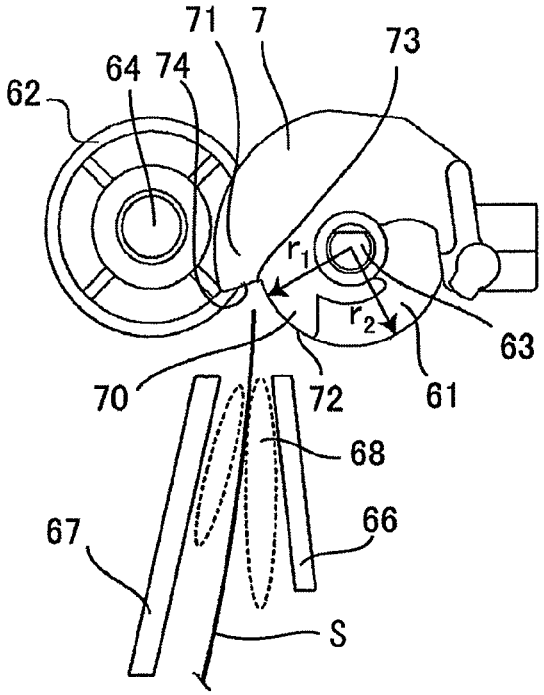
FIG. 3A is a view schematically illustrating a shutter portion in a first posture.
Figure 3B:
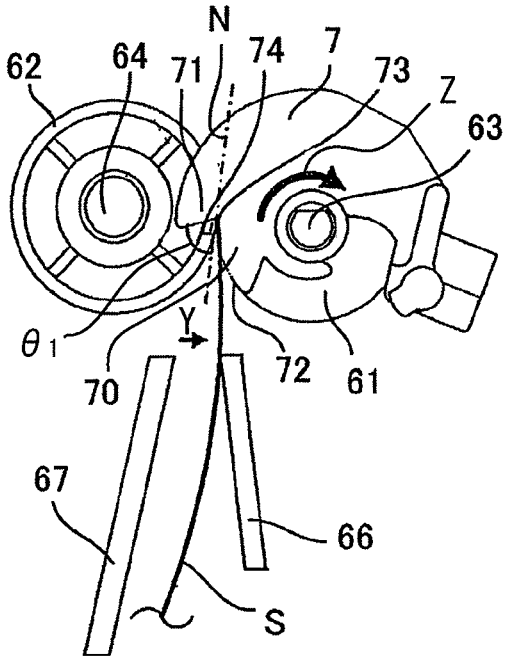
FIG. 3B is a view schematically illustrating a state in which a sheet is nipped by a nip portion.
Figure 3C:
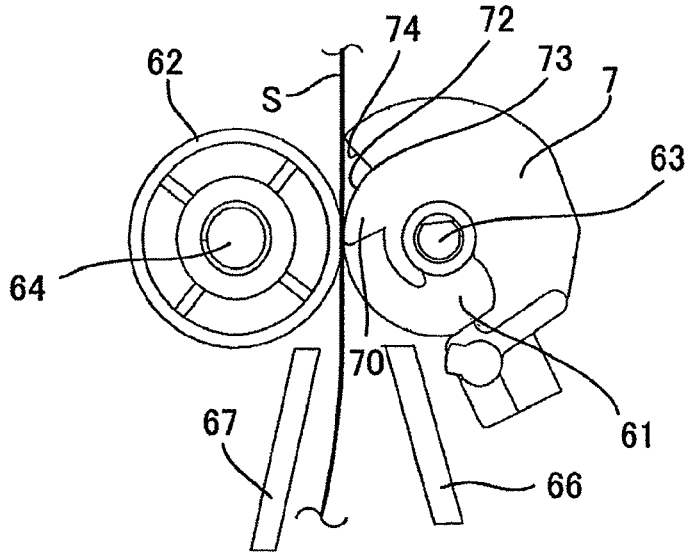
FIG. 3C is a view schematically illustrating a state in which a sheet is conveyed when the shutter portion is in a second posture.

Next, the skew feed correcting portion 6 that corrects the skew feed of a sheet will be described further specifically with reference to FIGS. 2 to 10. First, the entire structure of the skew feed correcting portion 6 will be described with reference to FIGS. 2 to 3C. FIG. 2 is a perspective view illustrating the internal structure of the skew feed correcting portion 6 according to the first embodiment. FIG. 3A is a view schematically illustrating a shutter portion 7 in a first posture. FIG. 3B is a view schematically illustrating the state in which the sheet S is nipped by a nip portion. FIG. 3C is a view schematically illustrating the state in which the sheet S is conveyed when the shutter portion 7 is in a second posture.

As illustrated in FIG. 2, the skew feed correcting portion 6 is disposed in the sheet conveying path 41, and includes a skew feed correcting portion main body 60, a plurality of conveying roller pairs 61 and 62, a plurality of shutter portions 7, and a connecting portion 65 that connects the plurality of shutter portions 7 to cause the respective shutter portions to move in conjunction with each other. The skew feed correcting portion main body 60 constitutes an outer appearance of the skew feed correcting portion 6, in the inside of which the conveying roller pairs 61 and 62 and the like are provided. Further, as illustrated in FIGS. 3A and 3B, the skew feed correcting portion main body 60 includes a guide frame 66 and a feed frame 67 that guide the sheet S having entered the skew feed correcting portion main body 60 toward the conveying roller pairs 61 and 62.

As illustrated in FIG. 3A, the guide frame 66 and the feed frame 67 are provided on an upstream side of the conveying roller pairs 61 and 62 and the shutter portion 7 in the conveying direction of the sheet S, and guide the sheet S to the conveying roller pairs 61 and 62 and the shutter portion 7. The guide frame 66 and the feed frame 67 are disposed so as to be positioned on both sides in the thickness direction of the sheet S, and regulate both sides in the thickness direction of the sheet S. Further, the guide frame 66 and the feed frame 67 are disposed at a predetermined distance so that the sheet S can be curved in the thickness direction of the sheet S when the sheet S is positioned between the guide frame 66 and the feed frame 67. Specifically, the guide frame 66 and the feed frame 67 are disposed in such a manner that a predetermined loop forming space 68 is provided between the sheet S and the guide frame 66 and between the sheet S and the feed frame 67 with centering around the sheet S.

The plurality of conveying roller pairs 61 and 62 convey the sheet S while nipping the sheet S. In this embodiment, five conveying roller pairs 61 and 62 are provided. The conveying roller pairs 61 and 62 include conveying rollers 61 as first conveying rollers, a first rotary shaft 63 as a rotary shaft of the conveying rollers 61, conveying rotatable members 62 as second conveying rollers, and a second rotary shaft 64 as a rotary shaft of the conveying rotatable members 62.

The conveying rollers 61 each have a radius of a roller radius $r_2$ and are fixed to the first rotary shaft 63 at predetermined intervals. The first rotary shaft 63 is rotatably supported by the skew feed correcting portion main body 60 substantially in parallel to the sheet width direction orthogonal to the conveying direction of the sheet S. The first rotary shaft 63 is connected to a drive source (not shown) and rotates the conveying rollers 61 by the rotation force transmitted from the drive source.

The plurality of conveying rotatable members 62 are disposed opposite to the conveying rollers 61 and rotatably supported by the second rotary shaft 64. The second rotary shaft 64 is supported by the skew feed correcting portion main body 60 in parallel to the first rotary shaft 63. The nip portions of the conveying roller pairs 61 and 62 are each formed of a contact point between the conveying roller 61 and the conveying rotatable member 62.

As illustrated in FIG. 2, the plurality of shutter portions 7 are disposed between the conveying rollers 61, and in this embodiment, four shutter portions 7 are provided. The shutter portions 7 are supported by the first rotary shaft 63 so as to be rotatable between a first position (see FIG. 3A) where the sheet S is positioned on an upstream side of the nip portion and a second position (see FIG. 3C) where the sheet S to be conveyed passes after being guided to the nip portion (see FIG. 3B).

In the following description, the posture of the shutter portions 7 at the first position is also referred to as a first posture (see FIG. 3A), and the posture of the shutter portions 7 at the second position is also referred to as a second posture (see FIG. 3C). Further, the shutter portions 7 are biased by a biasing member (not shown) in a direction opposite to a Z direction (see FIG. 3B) and supported by the first rotary shaft 63 so as to be kept in the first posture at the first position.

The plurality of shutter portions 7 abut against the sheet S on the upstream side in the conveying direction of the sheet S to restrain the sheet S, and then rotate to guide the sheet S to the nip portion. In other words, the plurality of shutter portions 7 abut against the sheet S to restrain the sheet S before the sheet S is nipped by the nip portion between the conveying roller 61 and the conveying rotatable member 62, and thereafter rotate to guide the sheet S to the nip portion.

As illustrated in FIG. 3A, the shutter portion 7 includes the same radius portion 70 formed into an arc shape in its side view with substantially the same radius (distance $r_1$ from the rotation center to a regulating surface 72) as the roller radius $r_2$ of the conveying roller 61, and an abutment portion 71 that protrudes from the same radius portion 70 and allows the leading edge of the sheet S to abut against the abutment portion 71. The same radius portion 70 includes the regulating surface 72 positioned on the same plane as the roller surface of the conveying roller 61, and the regulating surface 72 regulates so that the sheet S entering from between the guide frame 66 and the feed frame 67 does not move to the first rotary shaft 63 supporting the shutter portion 7.

The abutment portion 71 includes an abutment surface 74 against which the leading edge of the sheet S entering from between the guide frame 66 and the feed frame 67 abuts, and a base portion (boundary portion) 73 that is a boundary between the abutment surface 74 and the same radius portion 70. As illustrated in FIG. 3B, the abutment surface 74 is inclined so that an angle $\theta_1$ formed by the abutment surface 74 and a nip tangent N when the shutter portion 7 rotates and the base portion 73 of the abutment portion 71 is positioned in the nip portion of the conveying roller pairs 61 and 62 is an acute angle (90° or less). That is, the abutment surface 74 is formed so that $\theta_1 \leq 90°$ is satisfied until the leading edge of the sheet S reaches the nip portion of the conveying roller pairs 61 and 62 after abutting against the abutment surface 74 of the shutter portion 7. In other words, the abutment surface 74 is formed so that the leading edge of the sheet S abuts against the base portion 73 (the boundary portion with respect to the same radius portion 70) of the abutment portion 71 by the time the conveyed sheet S abuts against the abutment surface 74 and reaches the nip portion of the conveying roller pairs 61 and 62.

The base portion 73 restrains the leading edge of the sheet S that abuts against the abutment surface 74, and regulates the sheet S so that the leading edge of the sheet S is positioned on a straight line in the sheet width direction orthogonal to the conveying direction of the sheet S. Specifically, the base portion 73 regulates the sheet S so that the leading edge of the sheet S is placed on a straight line in the sheet width direction orthogonal to the sheet conveying direction during a period of time in which the sheet S moves to the nip portion due to the rotation of the shutter portion 7 after the leading edge of the sheet S abuts against the abutment portion 71.

Figure 4:
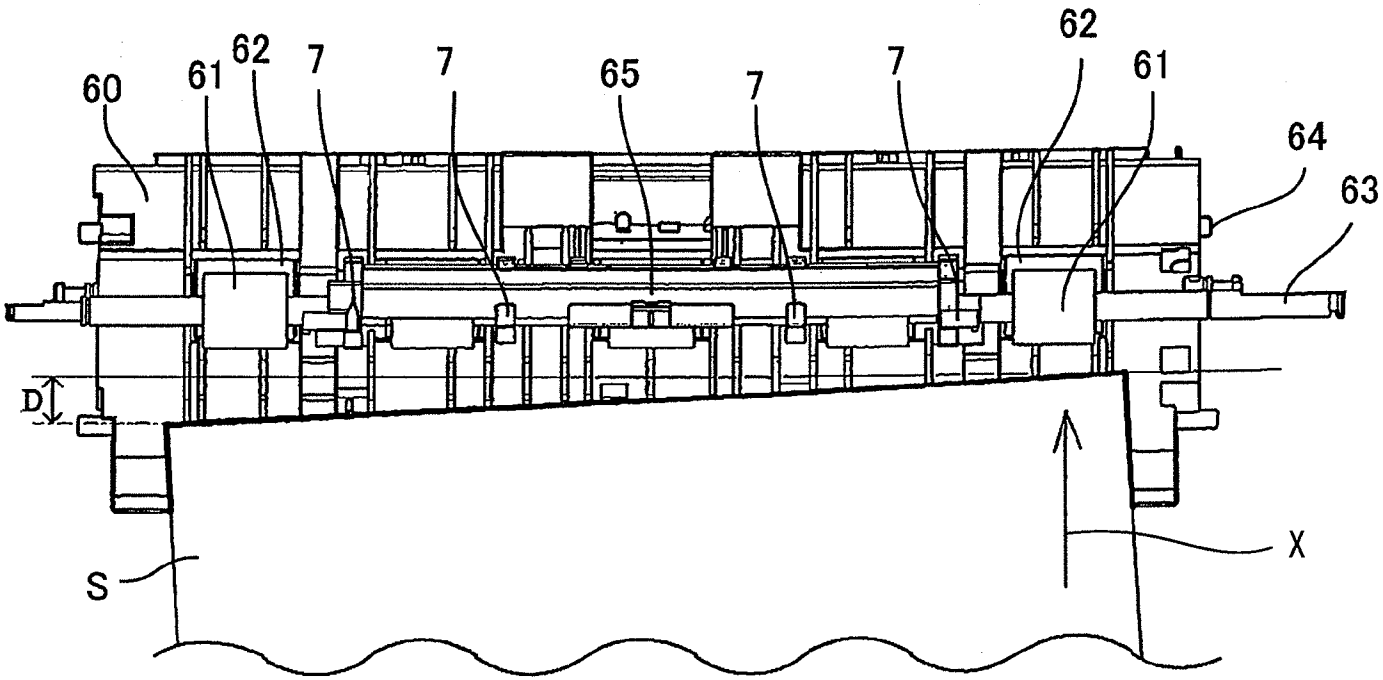
FIG. 4 is a view illustrating a state in which a skewed sheet enters the skew feed correcting portion.

Next, the skew feed correction of the sheet S in the skew feed correcting portion 6 will be described with reference to FIG. 4 as well as FIGS. 3A to 3C. FIG. 4 is a view illustrating the state in which the skewed sheet S enters the skew feed correcting portion 6.

The sheet S conveyed in a skewed state as illustrated in FIG. 4 is conveyed to the nip portion between the conveying roller pairs 61 and 62 while being guided by the guide frame 66 and the feed frame 67 as illustrated in FIG. 3A. When the sheet S is further conveyed, the preceding leading edge of the sheet S (leading edge of the sheet that is to precede due to the skew feed) first abuts against the abutment portion 71 of the shutter portion 7 in the first posture. When the leading edge of the sheet S abuts against the abutment portion 71 of the shutter portion 7, because the abutment surface 74 of the abutment portion 71 is formed so as to be inclined in a direction in which the sheet S is guided to the base portion 73 ($\theta_1 \leq 90°$ in the first posture), the leading edge of the sheet S moves toward the base portion 73. At this time, the shutter portion 7 is biased by a biasing member (not shown) so as to be in the first posture. Therefore, the shutter portion 7 does not rotate, and the base portion 73 is restrained by the shutter portion 7 while pressing the shutter portion 7.

When the preceding leading edge of the sheet S is restrained by the base portion 73, the leading edge of the sheet S successively abuts against the abutment surface 74 and is restrained by the base portion 73. When the sheet S is further conveyed in a sheet conveying direction X (FIG. 4) after the leading edge of the sheet S is restrained by the base portion 73, because the leading edge of the sheet S is restrained by the base portion 73, the sheet S slacks due to the reaction force. In this case, as illustrated in FIG. 3A, the predetermined loop forming space 68 is provided between the guide frame 66 and the feed frame 67. Therefore, the slack of the sheet S becomes a loop shape which is curved in a direction indicated by an arrow Y as illustrated in FIG. 3B in the loop forming space 68. As a result, the leading edge of the sheet S is aligned in a straight line uniformly so as to press the base portion 73. That is, the leading edge of the sheet S becomes parallel to the first rotary shaft 63, and the skew feed of the sheet S is corrected.

When the sheet S is further conveyed, the pressing force of the leading edge of the sheet S exerted on the base portions 73 increases due to the strength of the stiffness of the sheet S. When the force becomes larger than the above-mentioned reaction force, the shutter portions 7 rotatably supported by the first rotary shaft 63 rotate. At this time, because the leading edge of the sheet S presses the base portions 73, the sheet S moves with the leading edge thereof positioned at the base portions 73.

As illustrated in FIG. 3B, when the shutter portion 7 rotates and the base portion 73 is positioned on the side of the nip portion (i.e., the position substantially coinciding with the position of the nip portion in a sheet surface direction (radial direction of the conveying roller 61, which is the thickness direction of the sheet) orthogonal to the sheet conveying direction X), the leading edge of the sheet S is pushed into the nip portion. Then, the leading edge of the sheet S is nipped by the conveying rollers 61 and the conveying rotatable members 62. When the shutter portion 7 rotates, the leading edge of the sheet is guided by the base portion 73 so as to substantially coincide with the position of the nip portion in the sheet thickness direction to reach the nip portion. When the sheet S is nipped by the conveying rollers 61 and the conveying rotatable members 62, the first rotary shaft 63 rotates, and the conveying rollers 61 and the conveying rotatable members 62 rotate. When the conveying rollers 61 and the conveying rotatable members 62 rotate, the sheet S is conveyed while being nipped by the conveying rollers 61 and the conveying rotatable members 62, and the leading edge of the conveyed sheet S further presses the base portion 73, and thus the shutter portion 7 rotates. As illustrated in FIG. 3C, when the shutter portion 7 is positioned in the second posture, the restraint between the base portion 73 and the sheet S is released, and hence the sheet S is conveyed to a first conveying path. When the conveyance of the sheet S is completed, the shutter portion 7 is returned to the first posture by the biasing member (not shown).

Hereinafter, the operation of the sheet S in the case where the distance $r_1$ from the rotation center of the same radius portion 70 to the regulating surface 72 is different from the roller radius $r_2$ of the conveying roller 61 will be described with reference to FIGS. 5 to 9.

Figure 5:
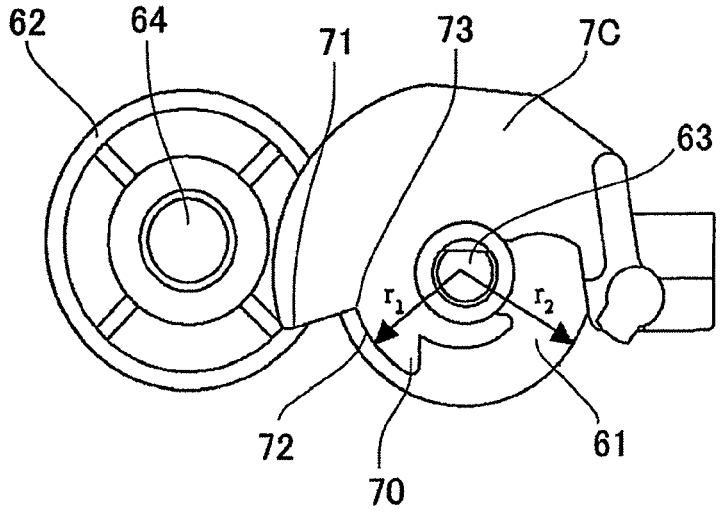
FIG. 5 is a view illustrating a guide member in which a distance $r_1$ from a rotation center to a regulating surface is shorter than a radius of a conveying roller.
Figure 6A:
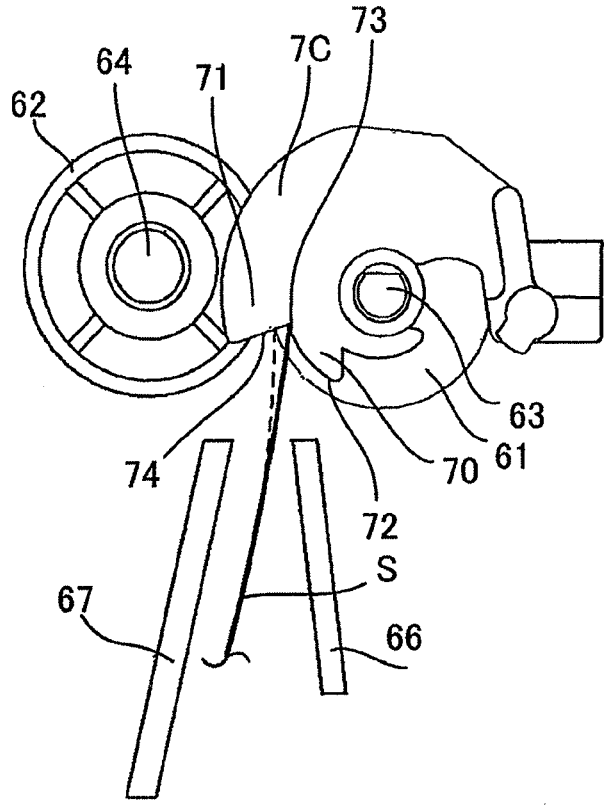
FIG. 6A is a view schematically illustrating a state in which the leading edge of a sheet is positioned in a base portion after abutting against an abutment portion.
Figure 6B:
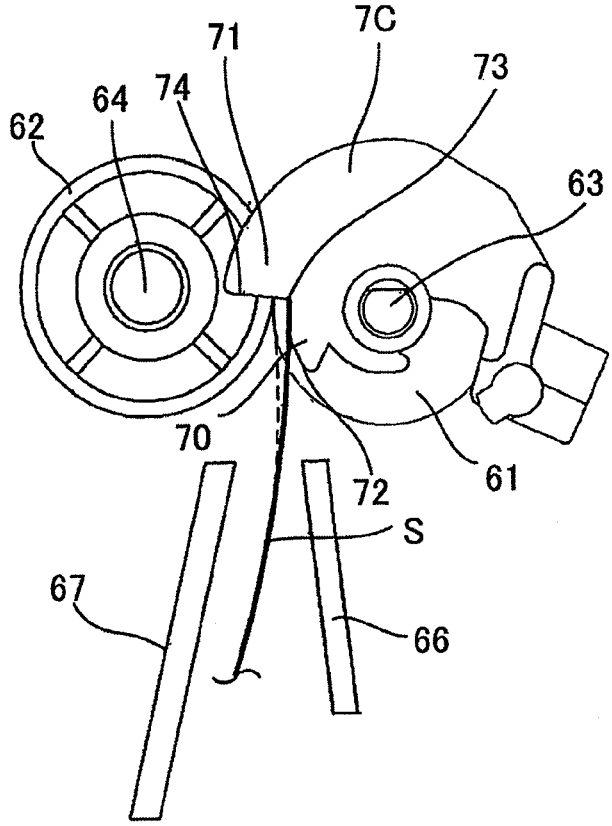
FIG. 6B is a view schematically illustrating a state in which the sheet positioned in the base portion as a result of the rotation of the shutter portion is guided to the nip portion.
Figure 7:
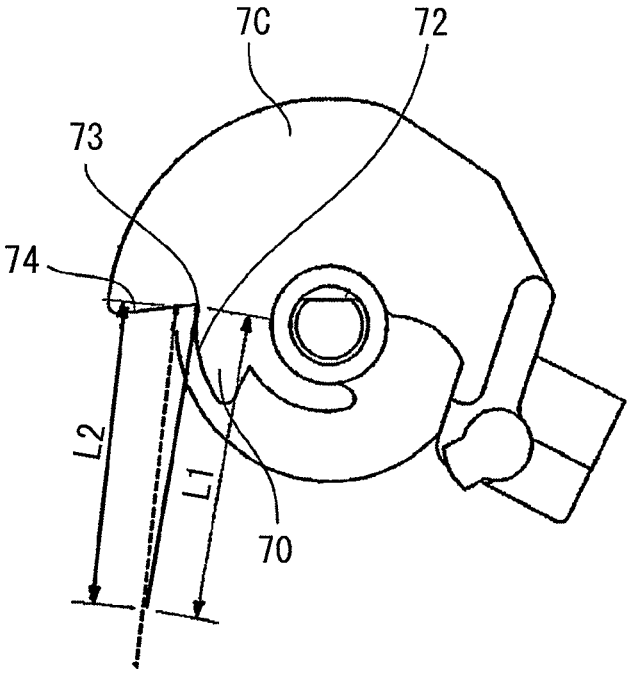
FIG. 7 is a view illustrating a state in which the leading edge of the sheet is positioned in the base portion and a state in which the leading edge of the sheet is positioned in the nip portion.
Figure 9:
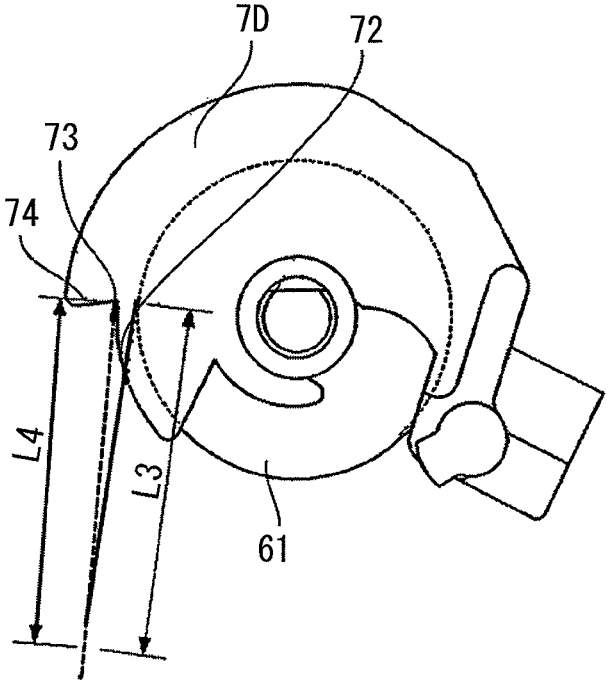
FIG. 9 is a view illustrating a state in which the leading edge of the sheet is positioned in the base portion and a state in which the leading edge of the sheet is positioned in the nip portion.
Figure 8A:
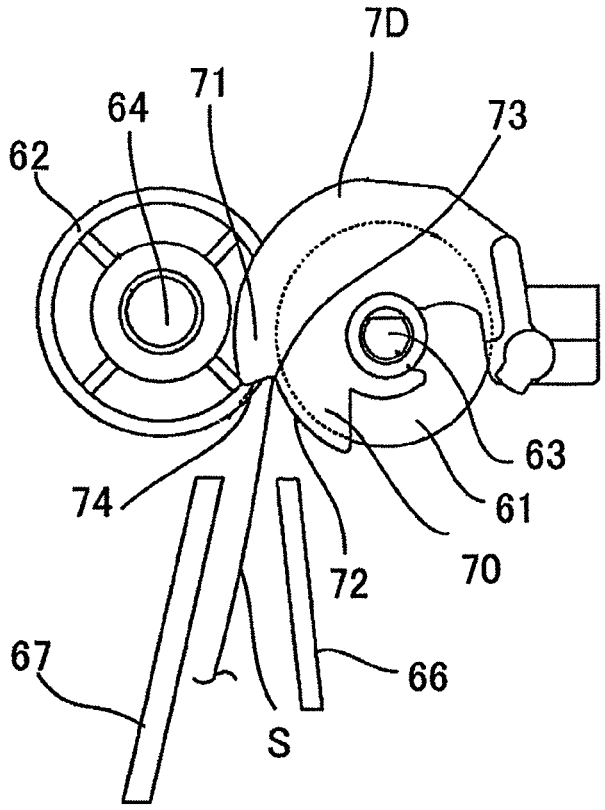
FIG. 8A is a view schematically illustrating a state in which the leading edge of the sheet is positioned in the base portion after abutting against the abutment portion.
Figure 8B:
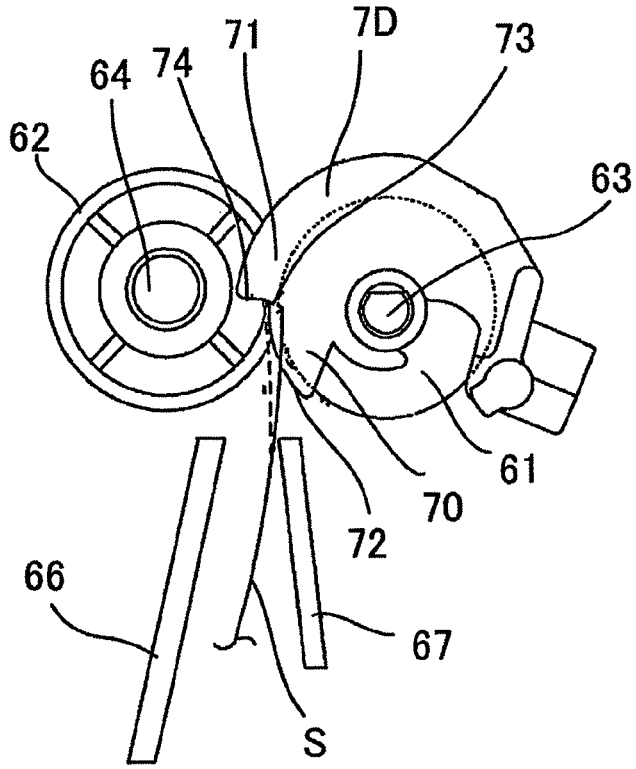
FIG. 8B is a view schematically illustrating a state in which the sheet positioned in the base portion as a result of the rotation of the shutter portion is guided to the nip portion.

FIG. 5 is a view illustrating a shutter portion 7C in which the distance $r_1$ from the rotation center to the regulating surface 72 is shorter than the roller radius $r_2$ of the conveying roller. FIG. 6A is a view schematically illustrating the state in which the leading edge of the sheet S is positioned in the base portion 73 after abutting against the abutment portion 71. FIG. 6B is a view schematically illustrating the state in which the sheet S positioned in the base portion 73 as a result of the rotation of the shutter portion 7C is guided to the nip portion. FIG. 7 is a view illustrating the state in which the leading edge of the sheet S is positioned in the base portion 73 and the state in which the leading edge of the sheet S is positioned in the nip portion. FIG. 8A is a view schematically illustrating the state in which the leading edge of the sheet S is positioned in the base portion 73 after abutting against the abutment portion 71. FIG. 8B is a view schematically illustrating the state in which the sheet S positioned in the base portion 73 as a result of the rotation of a shutter portion 7D is guided to the nip portion. FIG. 9 is a view illustrating the state in which the leading edge of the sheet S is positioned in the base portion 73 and the leading edge of the sheet S is positioned in the nip portion. In the following, the difference ($r_1-r_2$) between the distance $r_1$ from the rotation center of the same radius portion 70 to the regulating surface 72 and the roller radius $r_2$ of the conveying roller 61 is defined as a radius difference Δr.

As illustrated in FIG. 5, in the case where the distance $r_1$ is shorter than the roller radius $r_2$, that is, in the case where the radius difference Δr is negative, the sheet S restrained in the base portion 73 of the shutter portion 7C in the first posture is in the state illustrated in FIGS. 6A and 6B. At this time, on the leading edge side of the sheet S, the base portion 73 is positioned on the first rotary shaft 63 side with respect to the roller surface of the conveying roller 61. Therefore, at the leading edge of the sheet S, there exist a portion restrained in the base portion 73 (portion indicated by a solid line of FIG. 6A) and a portion positioned on the roller surface of the conveying roller 61 positioned on the outer side of the base portion 73 (portion indicated by a broken line of FIG. 6A). This causes a locally deformed state (undulating state in the width direction of the sheet). The local deformation hinders the formation of a loop which is curved in the sheet thickness direction (sheet surface direction orthogonal to the sheet conveying direction X), which makes it difficult to form an appropriately curved loop required for skew feed correction.

Further, the sheet S positioned in the nip portion is positioned above the base portion 73 due to the nip portion, and the leading edge position of the sheet S is positioned behind the portion restrained in the base portion 73 due to the abutment portion 71 (on a downstream side of the sheet conveying direction). Specifically, a length L1 illustrated in FIG. 7 (portion indicated by a solid line of FIG. 7) becomes larger than a length L2 (portion indicated by a broken line of FIG. 7). Therefore, a skew feed correction amount corresponding to "L1 (length of the solid line)–L2 (length of the broken line)" is lost.

Further, the sheet S is nipped by the nip portion of the conveying roller pairs 61 and 62 in an undulating state in the sheet width direction, and hence local fore-edge bending is liable to occur at the leading edge of the sheet S. Those tendencies appear more remarkably in a thinner sheet with weaker stiffness. The fore-edge bending may give a user an uncomfortable feeling, which may also lead to a paper jam. Therefore, it is necessary to avoid the fore-edge bending from the viewpoint of quality. Thus, it is not preferred that the distance $r_1$ be smaller than the roller radius $r_2$.

Next, in the case where the distance $r_1$ is longer than the roller radius $r_2$, that is, in the case where the radius difference Δr is positive, the sheet S restrained in the base portion 73 of the shutter portion 7D in the first posture is in the state illustrated in FIGS. 8A and 8B. At this time, on the leading edge side of the sheet S, the base portion 73 is positioned on the outer side of the roller surface of the conveying roller 61. Therefore, at the leading edge of the sheet S, there exist a portion restrained in the base portion 73 (portion indicated by a solid line of FIG. 8B) and a portion positioned on the roller surface on the second rotary shaft 64 side with respect to the base portion 73 (portion indicated by a broken line of FIG. 8B). This causes a locally deformed state (undulating state in the width direction of the sheet). The local deformation hinders the formation of a loop which is curved in the thickness direction of the sheet S, which makes it difficult to form an appropriately curved loop required for skew feed correction.

Further, the sheet S restrained in the base portion 73 is positioned above the roller surface, and the leading edge position of the sheet S is positioned behind the portion restrained in the base portion 73 due to the abutment portion 71 (on a downstream side of the sheet conveying direction). Specifically, a length L3 illustrated in FIG. 9 (portion indicated by a solid line of FIG. 9) becomes larger than a length L4 (portion indicated by a broken line of FIG. 9). Therefore, a skew feed correction amount corresponding to "L3 (length of the solid line)–L4 (length of the broken line)" is lost.

Further, the sheet S is nipped by the nip portion of the conveying roller pairs 61 and 62 in an undulating state in the sheet width direction, and hence local fore-edge bending is liable to occur at the leading edge of the sheet S. Those tendencies appear more remarkably in a thinner sheet with weaker stiffness. The fore-edge bending may give a user an uncomfortable feeling, which may also lead to a paper jam. Therefore, it is necessary to avoid the fore-edge bending from the viewpoint of quality. Thus, it is not preferred that the distance $r_1$ be longer than the roller radius $r_2$.

Figure 10:
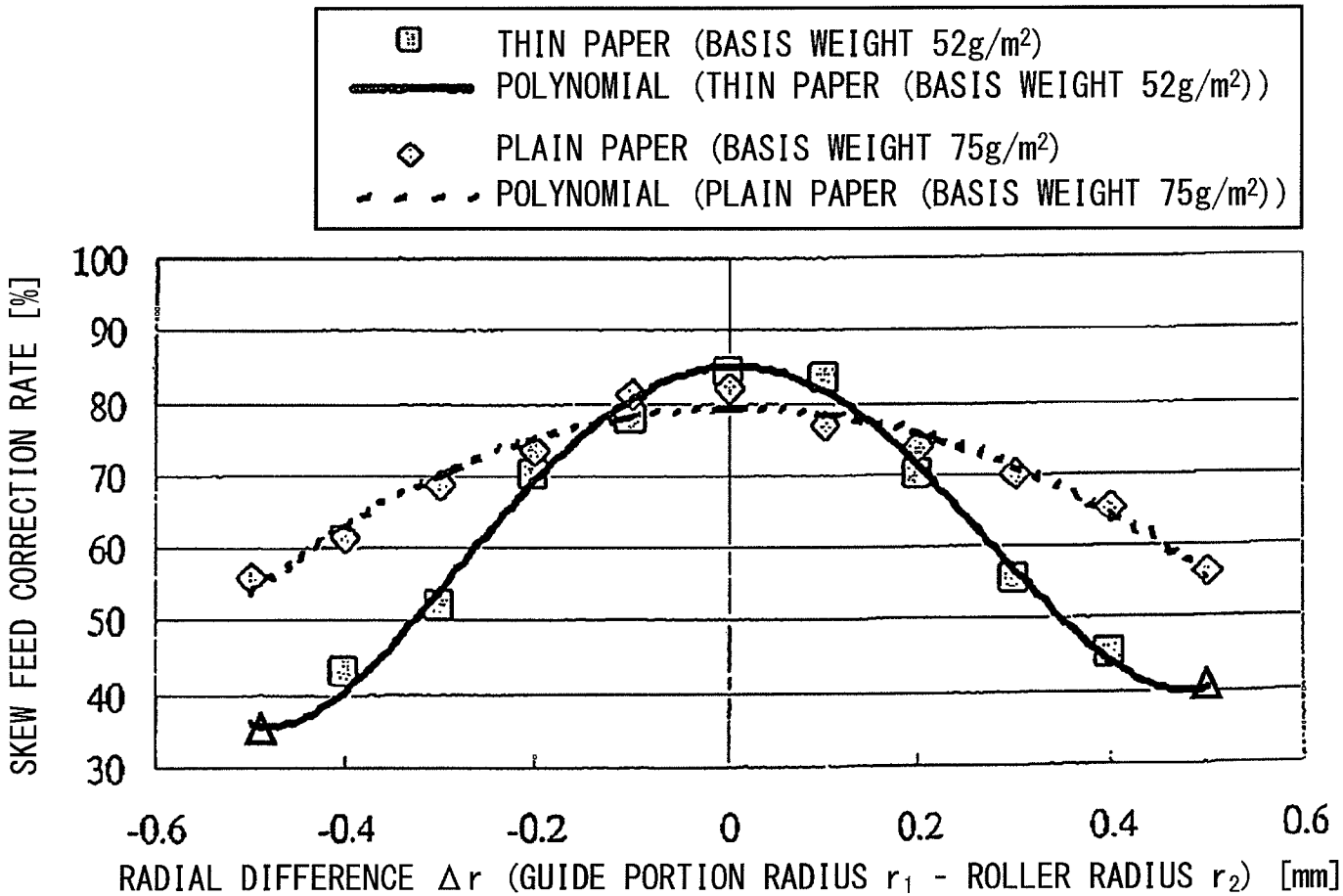
FIG. 10 is a graph illustrating a relationship between the difference in distance and the skew feed correction rate when the distance from the rotation center of the shutter portion to a regulating surface is changed.

Next, which degree of the above-mentioned radius difference Δr is desired will be described with reference to FIG. 10. FIG. 10 is a graph illustrating a relationship between the radius difference Δr (distance $r_1$ of the same radius portion–roller radius $r_2$ of the conveying roller) and the skew feed correction rate when the distance $r_1$ from the rotation center of the shutter portion to the regulating surface 72 is changed. In FIG. 10, a horizontal axis represents the radius difference Δr (mm) and a vertical axis represents the skew feed correction rate (%).

The skew feed correction rate (%) as used herein refers to a ratio between the skew feed amount ("skew feed amount D" illustrated in FIG. 4) immediately before the leading edge of the sheet S abuts against the shutter portion 7 and the skew feed amount of the sheet S immediately after the leading edge of the sheet S passes through the nip portion of the conveying roller pairs 61 and 62. That is, as the ratio is closer to 100%, higher skew feed correction ability is obtained. Further, as thin paper (sheet with a small basis weight), a sheet with a basis weight of 52 g/m$^2$ is used, and as plain paper (sheet with a standard basis weight), a sheet with a basis weight of 75 g/m$^2$ is used.

As illustrated in FIG. 10, there is a strong correlation between the radius difference Δr (mm) and the skew feed correction rate (%). That is, as the radius difference Δr is larger (leaves from 0), the skew feed correction rate (%) becomes lower, and as the radius difference Δr is smaller (approaches to 0), the skew feed correction rate (%) becomes higher. Thus, it is understood that it is desired to set the radius difference Δr to be smaller (closer to 0) from the viewpoint of the skew feed correction ability.

On the other hand, in the conventional image forming apparatus, the skew feed amount (see FIG. 4) of the sheet S before the sheet S abuts against the shutter portion is about 3.0 mm at most. In order to obtain appropriate recording precision, the skew feed amount of the sheet S after the sheet passes through the nip portion of the conveying roller pairs 61 and 62 is desired to be set within 1.0 mm. That is, it is practically preferred that the skew feed correction rate (%) exceed 70%. In FIG. 10, it is understood that the range in which the skew feed correction rate (%) of thin paper and plain paper exceeds 70% is −0.2 mm to +0.2 mm.

Further, it is necessary to consider the fore-edge bending of the leading edge of the sheet S as well. Here, a plot indicated by a mark Δ illustrated in FIG. 10 shows conditions under which the fore-edge bending occurs at the leading edge of the sheet S when the state of the sheet S after being fed is visually checked. In FIG. 10, it is understood that the range in which the fore-edge bending does not occur in thin paper is −0.4 mm to +0.4 mm.

The laser beam printer 1 according to the first embodiment having the above-mentioned configuration exhibits the following effects. In the laser beam printer 1 according to the first embodiment, the distance $r_1$ from the rotation center of the same radius portion 70 to the regulating surface 72 is set to be substantially the same as the roller radius $r_2$ of the conveying roller 61. Therefore, the base portion 73 of the abutment portion 71 can be positioned on substantially the same plane as the roller surface of the conveying roller 61. Thus, the local deformation of the leading edge of the sheet S, which can occur when the sheet S is restrained in the base portion 73 of the shutter portion 7, can be suppressed, and an appropriately curved loop to be required for skew feed correction can be formed easily. As a result, when the leading edge of the sheet S reaches the nip portion of the roller pairs 61 and 62 as a result of the rotation of the shutter portion 7, the leading edge of the sheet S does not undulate locally and can be corrected easily to the state in which the leading edge is positioned in a straight line in the sheet width direction orthogonal to the conveying direction. That is, the laser beam printer 1 according to the first embodiment can obtain high skew feed correction ability.

Further, the laser beam printer 1 includes the abutment portion 71 in which an angle $\theta_1$ formed by the abutment surface 74 and the nip tangent N is an acute angle (90° or less) when the base portion 73 is positioned in the nip portion of the conveying roller 61 and the conveying rotatable member 62 as a result of the rotation of the shutter portion 7. Therefore, after the conveyed sheet S abuts against the abutment surface 74, the leading edge of the sheet S can be moved easily to the base portion 73 that is on substantially the same plane as the roller surface of the conveying roller 61. Thus, the leading edge of the sheet S can be easily adapted so as to be positioned in a straight line in the sheet width direction orthogonal to the conveying direction of the sheet S.

Further, the laser beam printer 1 according to the first embodiment is constituted by the guide frame 66 and the feed frame 67, and has the loop forming space 68 in which the sheet S is capable of being curved in the thickness direction in the sheet conveying path. Therefore, an appropriately curved loop for positioning the leading edge of the sheet S in a straight line in a direction orthogonal to the conveying direction of the sheet S can be formed easily. Thus, the leading edge of the sheet S can be easily adapted so as to be positioned in a straight line in the sheet width direction orthogonal to the conveying direction of the sheet S.

The laser beam printer 1 according to the first embodiment can suppress the local deformation of the sheet S, and hence can suppress the fore-edge bending of the sheet S. Further, even for thin paper (for example, a sheet of less than 60 g/m$^2$) with a basis weight smaller than those of conventionally used sheets, the laser beam printer 1 can perform skew feed correction preferably, and hence can keep the recording precision. Further, the laser beam printer 1 according to the first embodiment can be used for sheets of various sizes because of the plurality of shutter portions 7.

Second Embodiment

Figure 11:
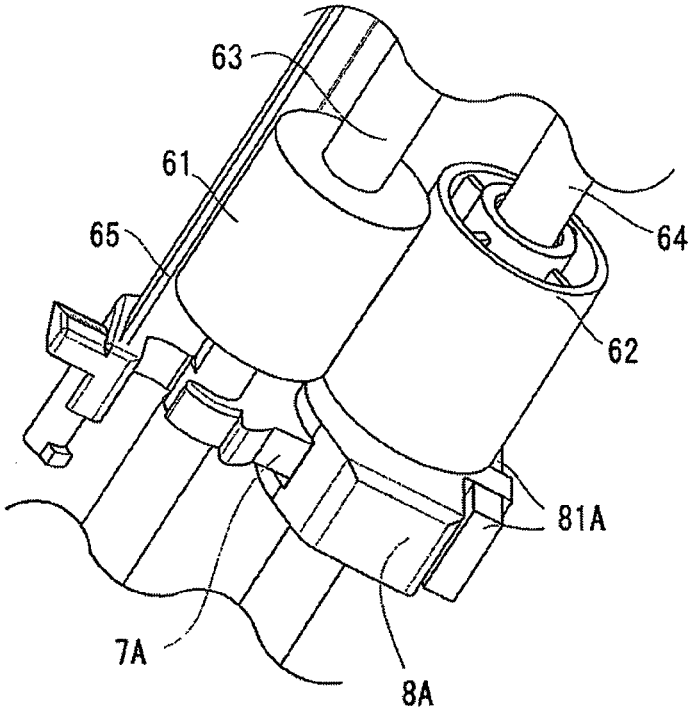
FIG. 11 is a partially enlarged view illustrating a skew feed correcting portion according to a second embodiment.
Figure 12:
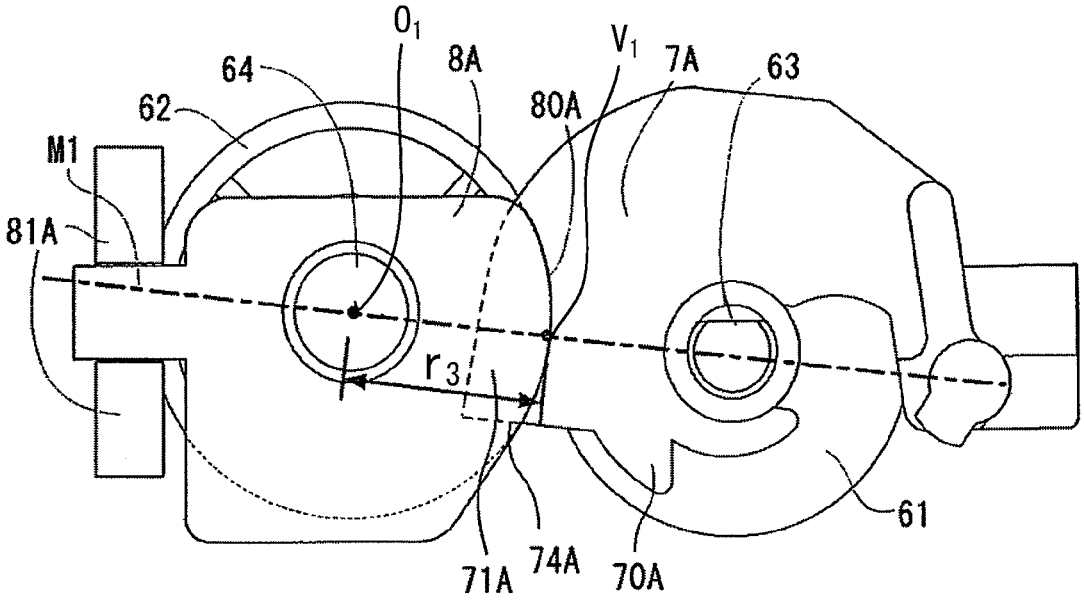
FIG. 12 is a view illustrating a shutter portion and a fixed guide portion according to the second embodiment.
Figure 13A:
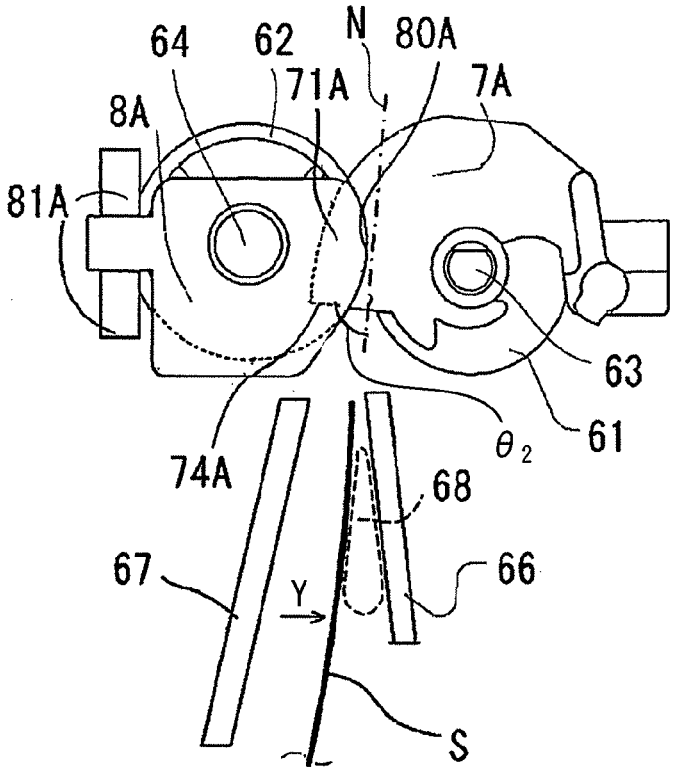
FIG. 13A is a view schematically illustrating the shutter portion in a first posture.
Figure 13B:
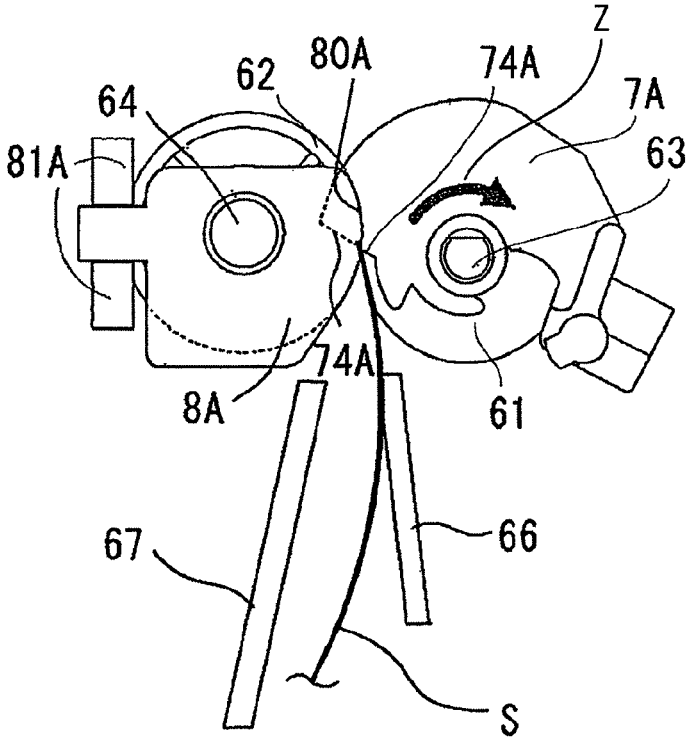
FIG. 13B is a view schematically illustrating a state in which the sheet is nipped by the nip portion as a result of the rotation of the shutter portion.

Next, a laser beam printer 1A according to a second embodiment of the present invention will be described with reference to FIGS. 11 to 13B. FIG. 11 is a partially enlarged view illustrating a skew feed correcting portion 6A according to the second embodiment. FIG. 12 is a view illustrating a shutter portion 7A and a fixed guide portion 8A according to the second embodiment. FIG. 13A is a view schematically illustrating the shutter portion 7A in the first posture and the fixed guide portion 8A. FIG. 13B is a view schematically illustrating the state in which the sheet S is nipped by the nip portion as a result of the rotation of the shutter portion 7A.

The laser beam printer 1A according to the second embodiment is different from the laser beam printer 1 according to the first embodiment in the skew feed correcting portion in the sheet conveying portion. Therefore, in the second embodiment, the point different from the first embodiment, that is, the skew feed correcting portion 6A of the sheet conveying portion 4A will be mainly described. In the second embodiment, the configurations similar to those of the laser beam printer 1 according to the first embodiment are denoted by the same reference symbols and the description thereof is omitted. Thus, in the second embodiment, the configurations similar to those of the first embodiment exhibit effects similar to those of the first embodiment.

First, the entire structure of the laser beam printer 1A according to the second embodiment will be described with reference to FIG. 1. As illustrated in FIG. 1, the laser beam printer 1A according to the second embodiment includes a sheet feed portion 2 that feeds a sheet S, an image forming portion 3*a* that forms an image, and a fixing portion 3*b* that fixes the image. The laser beam printer 1A further includes the sheet conveying portion 4A as a sheet conveying apparatus and a sheet discharge portion 5 that discharges the sheet S with an image formed thereon.

The sheet conveying portion 4A includes a sheet conveying path 41, a transfer belt 42, a duplex conveying path 43, a skew feed roller pair 44, a U-turn roller pair 45, and the skew feed correcting portion 6A. The skew feed correcting portion 6A includes a skew feed correcting portion main body 60, conveying roller pairs 61 and 62, a plurality of shutter portions 7A, a plurality of fixed guide portions 8A as guide portions, and a connecting portion 65 that connects the plurality of shutter portions 7A.

As illustrated in FIGS. 11 to 13B, the shutter portion 7A is disposed between the conveying rollers 61 and rotatably supported by the first rotary shaft 63. Specifically, the shutter portion 7A is rotatably supported between a first posture (see FIG. 13A) in which the leading edge of the sheet S abuts against the shutter portion 7A on an upstream side of the nip portion and a second posture in which the conveyed sheet S passes through the shutter portion 7A after being guided to the nip portion. The shutter portion 7A is biased by a biasing member (not shown) so as to be kept in the first posture, when the shutter portion 7A is not in contact with the sheet S.

The shutter portion 7A abuts against the sheet S to restrain the sheet S before the sheet S is nipped by the nip portion of the conveying roller pairs 61 and 62 (on an upstream side in the sheet conveying direction), and thereafter rotates to guide the sheet S to the nip portion. As illustrated in FIG. 12, the shutter portion 7A includes an abutment portion 71A which is formed so as to protrude from a regulating portion 70A so that the sheet abuts against the abutment portion 71A prior to the nip portion.

The regulating portion 70A regulates so that the sheet S entering from between the guide frame 66 and the feed frame 67 does not move to the first rotary shaft 63 supporting the shutter portion 7A.

The abutment portion 71A includes an abutment surface 74A against which the leading edge of the sheet S entering from between the guide frame 66 and the feed frame 67 abuts. As illustrated in FIG. 13A, the abutment surface 74A is formed so that an angle θ2 formed by the abutment surface 74A in the first posture and the nip tangent N is an obtuse angle (90° or more). That is, the abutment surface 74A is inclined so as to satisfy $\theta_2>90°$ until the leading edge of the sheet S is nipped by the nip portion of the conveying roller pairs 61 and 62 after abutting against the abutment surface 74A of the shutter portion 7A. In other words, the abutment surface 74A is inclined in a direction in which the leading edge of the sheet S is guided onto substantially the same plane as the roller surface of the conveying rotatable member 62 until the leading edge is nipped by the nip portion after the conveyed sheet S abuts against the abutment surface 74A.

As illustrated in FIG. 11, the fixed guide portion 8A is disposed opposite to the shutter portion 7A while being supported by the second rotary shaft 64, and is fixed to the skew feed correcting portion main body 60 by a fixing portion 81A.

As illustrated in FIG. 12, the fixed guide portion 8A includes a guide portion 80A as a guide surface having an arc shape in side view. The guide portion 80A is formed so that the distance from a rotation center $O_1$ of the second rotary shaft 64 is the same as a roller radius $r_3$ of the conveying rotatable member 62. Specifically, the guide portion 80A is formed to have substantially the same length ($=|O_1V_1|$) as the roller radius $r_3$ of the conveying rotatable member 62 in the vicinity of an intersection $V_1$ with a line M connecting the rotation center of the conveying roller 61 and the rotation center of the conveying rotatable member 62. Therefore, the guide portion 80A has substantially the same shape as that of the roller surface (outer circumferential surface) of the conveying rotatable member 62 and is positioned on substantially the same plane as the roller surface of the conveying rotatable member 62. That is, the guide portion 80A is always positioned on substantially the same plane as the roller surface of the conveying rotatable member 62 even when the conveying rotatable member 62 rotates. Thus, the fixed guide portion 8A can guide the sheet S to the nip portion together with the abutment portion 71A while positioning the leading edge of the sheet S on substantially the same plane as the roller surface of the conveying rotatable member 62 after the leading edge of the sheet S abuts against the abutment surface 74A of the shutter portion 7A.

Next, the skew feed correction of the sheet S in the skew feed correcting portion 6A will be described with reference to FIGS. 13A and 13B. The sheet S conveyed while being skewed as illustrated in FIG. 4 is conveyed toward the nip portion of the conveying roller pairs 61 and 62 while being guided by the guide frame 66 and the feed frame 67 as illustrated in FIG. 13A. When the sheet S is conveyed further in the conveying direction, the preceding leading edge of the sheet S (leading edge of the sheet that is to precede due to the skew feed) first abuts against the abutment portion 71A of the shutter portion 7A in the first posture. When the leading edge of the sheet S abuts against the abutment portion 71A of the shutter portion 7A, because the abutment surface 74A of the abutment portion 71A is inclined at an obtuse angle ($\theta_2>90°$) in a direction in which the sheet S is guided to the guide portion 80A of the fixed guide portion 8A, the leading edge of the sheet S moves toward the guide portion 80A. At this time, the shutter portion 7A is biased so as to be in the first posture by a biasing member (not shown). Therefore, the shutter portion 7A does not rotate, and the leading edge of the sheet S having moved along the guide portion 80A is restrained by the boundary between the abutment surface 74A and the guide portion 80A while pressing the abutment surface 74A.

When the leading edge of the sheet S that precedes while being skewed is restrained by the boundary between the abutment surface 74A and the guide portion 80A, the leading edge of the sheet S successively abuts against the abutment surface 74A and is restrained by the boundary between the abutment surface 74A and the guide portion 80A. When the sheet S is further conveyed in the sheet conveying direction after the leading edge of the sheet S is restrained by the boundary between the abutment surface 74A and the guide portion 80A, because the leading edge of the sheet S is restrained by the boundary between the abutment surface 74A and the guide portion 80A, the sheet S slacks due to the reaction force.

Here, as illustrated in FIG. 13A, a predetermined loop forming space 68 is provided between the guide frame 66 and the feed frame 67. Therefore, the slack of the sheet S forms a loop which is curved in a direction indicated by an arrow Y as illustrated in FIG. 13A in the loop forming space 68. Thus, the leading edge of the sheet S is aligned in a straight line uniformly so that the leading edge of the sheet S presses the boundary between the abutment surface 74A and the guide portion 80A. That is, the leading edge of the sheet S becomes parallel to the first rotary shaft 63, and thus the skew feed of the sheet S is corrected.

When the sheet S is further conveyed, the force at which the leading edge of the sheet S presses the boundary between the abutment surface 74A and the guide portion 80A increases, and the shutter portion 7A rotatably supported by the first rotary shaft 63 rotates. At this time, the leading edge of the sheet S presses the boundary between the abutment surface 74A and the guide portion 80A, and hence the sheet S moves while the leading edge thereof presses the boundary between the abutment surface 74A and the guide portion 80A.

When the boundary between the abutment surface 74A and the guide portion 80A is disposed at a position where the position of the nip portion coincides with the position in the sheet surface direction orthogonal to the sheet conveying direction, the leading edge of the sheet S positioned at the boundary between the abutment surface 74A and the guide portion 80A is pushed into the nip portion. Then, the sheet S is nipped by the conveying roller 61 and the conveying rotatable member 62. When the sheet S is nipped between the conveying roller 61 and the conveying rotatable member 62, the first rotary shaft 63 rotates, and the conveying roller 61 and the conveying rotatable member 62 rotate.

When the conveying roller 61 and the conveying rotatable member 62 rotate, the sheet S is conveyed while being nipped therebetween, and the leading edge of the conveyed sheet S further presses the abutment surface 74A to rotate the shutter portion 7A. When the shutter portion 7A is in the second posture, the restraint between the abutment surface 74A and the sheet S is released, and hence the sheet S is conveyed in the first conveying path. When the conveyance of the sheet S is completed, the shutter portion 7A is returned to the first posture by the biasing member (not shown).

The laser beam printer 1A according to the second embodiment having the above-mentioned configuration can exhibit the following effects in addition to the effects obtained by the similar configuration in the first embodiment. The laser beam printer 1A according to the second embodiment includes the guide portion 80A which is formed so that the distance from the rotation center of the second rotary shaft 64 is the same as the roller radius $r_3$ of the conveying rotatable member 62. Therefore, when the leading edge of the sheet S reaches the nip portion, the sheet S can be positioned along the guide portion 80A disposed on substantially the same plane as the roller surface of the conveying rotatable member 62. That is, when the leading edge of the sheet S reaches the nip portion, the leading edge of the sheet S can be guided so that the position of the nip portion coincides with the leading edge position of the sheet S in the sheet surface direction orthogonal to the sheet conveying direction.

Accordingly, the local deformation at the leading edge of the sheet S, which can occur when the leading edge of the sheet S reaches the nip portion, can be suppressed, and an appropriately curved loop to be required for skew feed correction can be formed easily. Consequently, when the leading edge of the sheet S reaches the nip portion of the conveying roller pairs 61 and 62 as a result of the rotation of the shutter portion 7A, the leading edge of the sheet S does not undulate locally and can be easily corrected to the state in which the leading edge of the sheet S is positioned in a straight line in a direction orthogonal to the conveying direction. That is, the laser beam printer 1A according to the second embodiment can exhibit high skew feed correction ability.

The laser beam printer 1A according to the second embodiment includes the abutment portion 71A that is inclined so that the angle $\theta_2$ formed by the abutment surface 74A and the nip tangent N is an obtuse angle (90° or more) when the leading edge of the sheet S reaches the nip portion as a result of the rotation of the shutter portion 7A. Therefore, after the conveyed sheet S abuts against the abutment surface 74A, the leading edge of the sheet S can be moved easily to the guide portion 80A side disposed on substantially the same plane as the roller surface of the conveying rotatable member 62.

Third Embodiment

Figure 14:
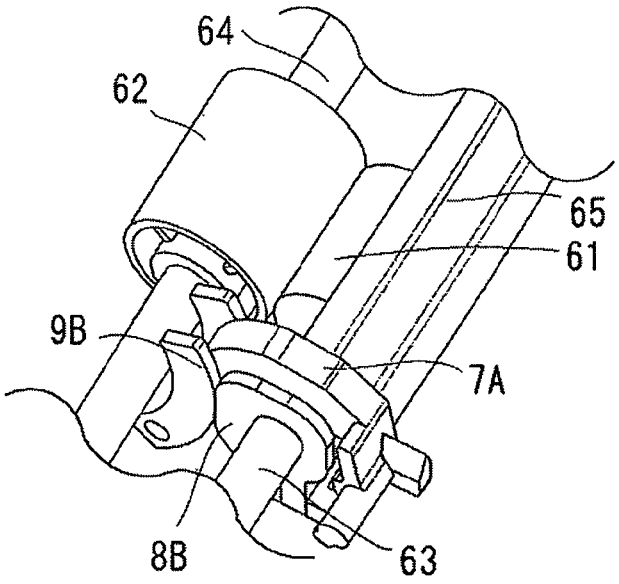
FIG. 14 is a partially enlarged view illustrating a skew feed correcting portion according to a third embodiment.
Figure 15:
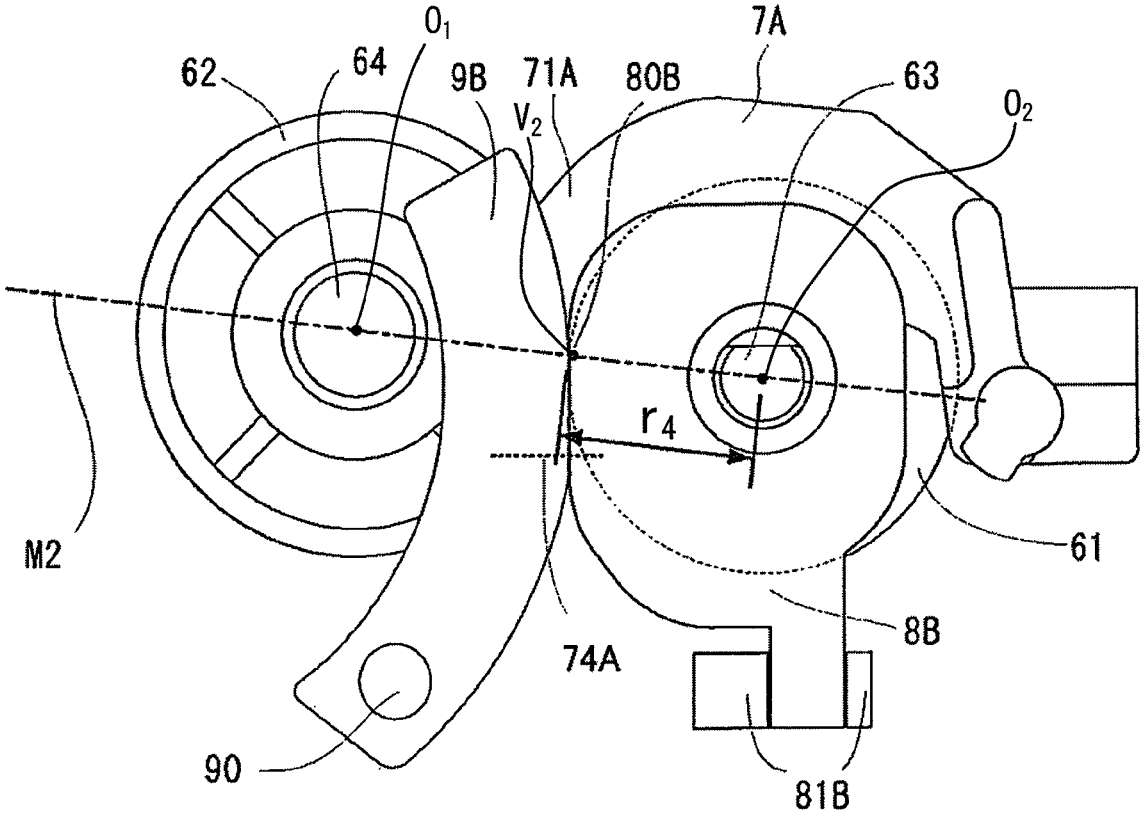
FIG. 15 is a view illustrating a shutter portion, a fixed guide portion, and a swinging guide portion according to the third embodiment.
Figure 16A:
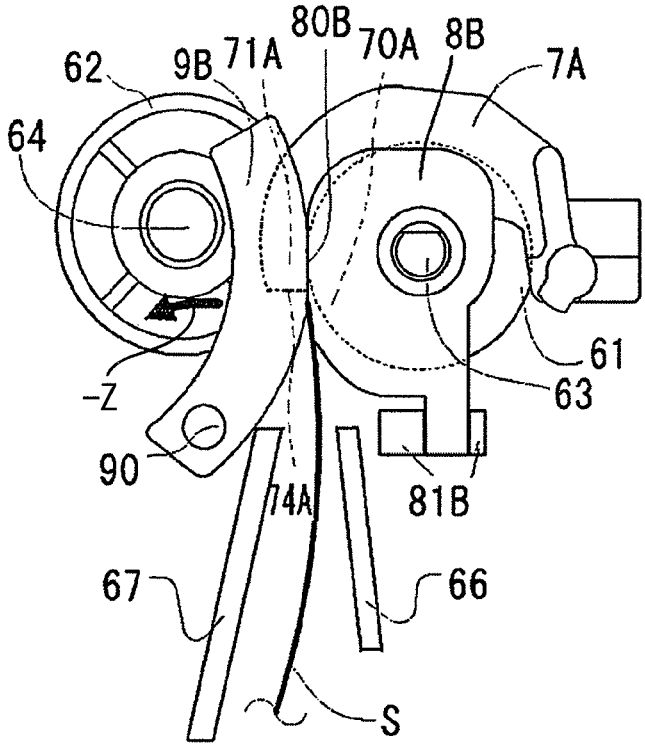
FIG. 16A is a view schematically illustrating the shutter portion in a first posture.
Figure 16B:
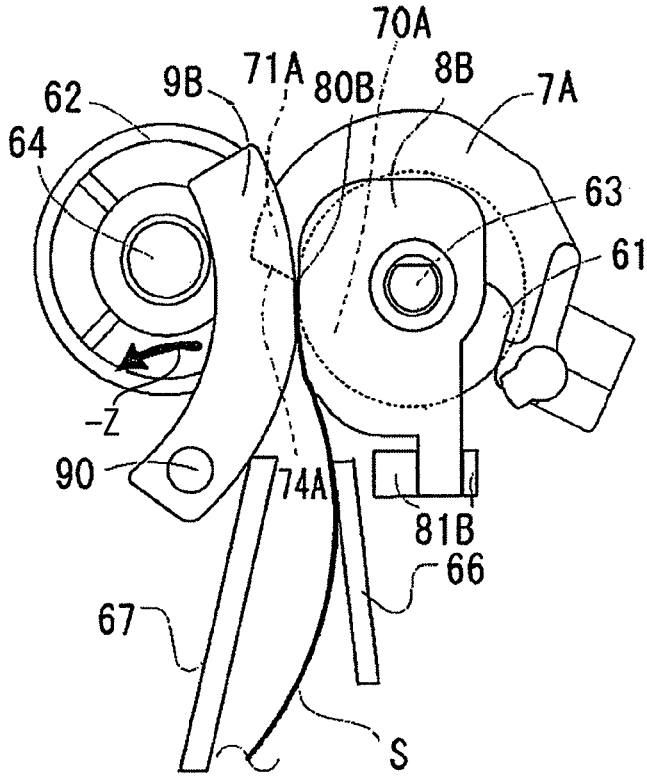
FIG. 16B is a view schematically illustrating a state in which the sheet is nipped by the nip portion.
Figure 17:
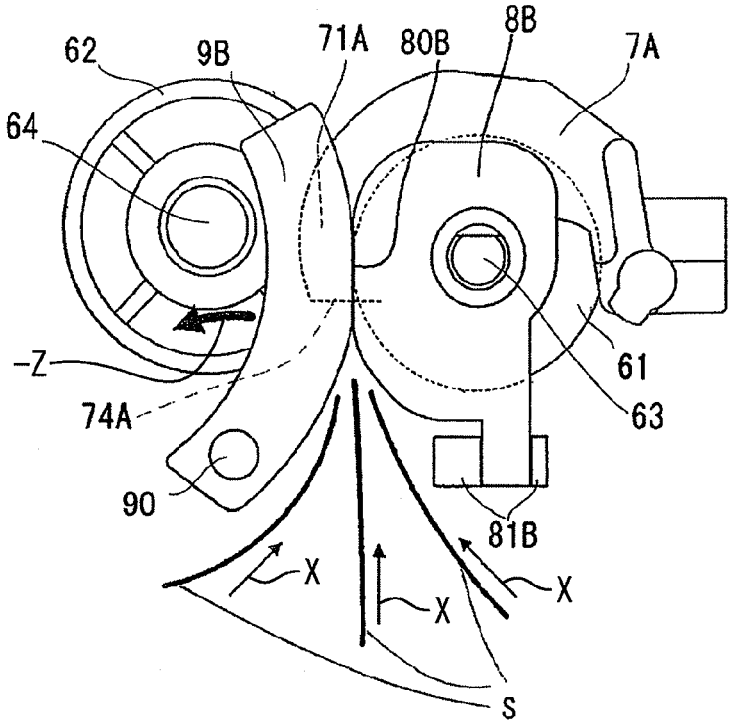
FIG. 17 is a view illustrating a plurality of conveying postures of the sheet abutting against the abutment surface of the shutter portion according to the third embodiment.

Next, a laser beam printer 1B according to a third embodiment of the present invention will be described with reference to FIGS. 14 to 17. FIG. 14 is a partially enlarged view illustrating a skew feed correcting portion 6B according to the third embodiment. FIG. 15 is a view illustrating a shutter portion 7A, a fixed guide portion 8B, and a swinging guide portion 9B according to the third embodiment. FIG. 16A is a view schematically illustrating the shutter portion 7A in the first posture. FIG. 16B is a view schematically illustrating a state in which the sheet S is nipped by the nip portion. FIG. 17 is a view illustrating a plurality of conveying postures of the sheet S that abuts against an abutment surface 74A of the shutter portion 7A according to the third embodiment.

The laser beam printer 1B according to the third embodiment is different from the laser beam printers 1 and 1A according to the first embodiment and the second embodiment in the skew feed correcting portion in the sheet conveying portion. Therefore, in the third embodiment, the point different from the first embodiment and the second embodiment, that is, the skew feed correcting portion 6B of the sheet conveying portion 4B will be mainly described.

In the third embodiment, the configurations similar to those of the laser beam printers according to the first embodiment and the second embodiment are denoted by the same reference symbols and the description thereof is omitted. Thus, in the third embodiment, the configurations similar to those of the first embodiment and the second embodiment exhibit effects similar to those of the first embodiment and the second embodiment.

First, the entire structure of the laser beam printer 1B according to the third embodiment will be described with reference to FIG. 1. As illustrated in FIG. 1, the laser beam printer 1B according to the third embodiment includes a sheet feed portion 2 that feeds a sheet S, an image forming portion 3*a* that forms an image, and a fixing portion 3*b* that fixes the image. The laser beam printer 1B further includes the sheet conveying portion 4B as a sheet conveying apparatus and a sheet discharge portion 5 that discharges the sheet S with an image formed thereon.

The sheet conveying portion 4B includes a sheet conveying path 41, a transfer belt 42, a duplex conveying path 43, a skew feed roller pair 44, a U-turn roller pair 45, and the skew feed correcting portion 6B. The skew feed correcting portion 6B includes a skew feed correcting portion main body 60, conveying roller pairs 61 and 62, a plurality of shutter portions 7A, a plurality of fixed guide portions 8B, a plurality of swinging guide portions 9B, and a connecting portion 65 that connects the plurality of shutter portions 7A.

As illustrated in FIG. 14, the fixed guide portions 8B are disposed opposite to the swinging guide portions 9B in a state of being supported by the first rotary shaft 63 on both sides of the shutter portion 7A, and are fixed to the skew feed correcting portion main body 60 by the fixing portion 81B. After the leading edge of the sheet S abuts against the abutment surface 74A of the shutter portion 7A, the fixed guide portion 8B guides the sheet S to the nip portion together with the abutment portion 71A while positioning the leading edge of the sheet S on the same plane as the roller surface of the conveying roller 61.

As illustrated in FIG. 15, the fixed guide portion 8B includes a guide portion 80B having an arc shape in side view. The guide portion 80B is formed so that the distance from a rotation center $O_2$ of the first rotary shaft 63 is the same as a roller radius $r_3$ of the conveying roller 61. Specifically, the guide portion 80B is formed to have substantially the same length ($=|O_2V_2|$) as the roller radius $r_4$ of the conveying roller 61 in the vicinity of an intersection $V_2$ with a line M2 connecting the rotation center of the conveying roller 61 and the rotation center of the conveying rotatable member 62. Therefore, the guide portion 80B has substantially the same shape as that of the roller surface (outer circumferential surface) of the conveying roller 61 and is positioned on substantially the same plane as the roller surface of the conveying roller 61. That is, the guide portion 80B is always positioned on substantially the same plane as the roller surface of the conveying roller 61 even when the conveying roller 61 rotates.

Further, the fixed guide portion 8B is disposed in a comb teeth shape with respect to the shutter portion 7A. Therefore, the fixed guide portion 8B suppresses the local deformation of the leading edge of the sheet S until the leading edge of the sheet S is nipped by the nip portion of the conveying roller pairs 61 and 62 from an upstream side of the abutment surface 74A of the shutter portion 7A, without hindering the rotation of the shutter portion 7A.

The swinging guide portion 9B is disposed opposite to the fixed guide portion 8B while being swingably supported by a swinging shaft 90. Further, the swinging guide portion 9B is always kept in the posture state illustrated in FIG. 15 by a biasing member (not shown). The swinging shaft 90 is rotatably supported by the skew feed correcting portion main body 60.

The swinging guide portion 9B abuts against the fixed guide portion 8B from the abutment surface 74A of the shutter portion 7A to a downstream side in a sheet conveying direction X with respect to the nip portion ($V_2$ illustrated in FIG. 15) of the conveying roller pairs 61 and 62. The swinging shaft 90 of the swinging guide portion 9B is provided at any position that does not hinder the conveyance of the sheet S. Further, the swinging guide portion 9B is configured so as to strike the second rotary shaft 64 after swinging (rotating) by a predetermined amount. Therefore, the swinging guide portion 9B suppresses the width of the conveying path to a predetermined width or less when the sheet S abuts against the swinging guide portion 9B.

Next, the skew feed correction of the sheet S in the skew feed correcting portion 6A will be described with reference to FIGS. 16A and 16B. When the sheet S abuts against the swinging guide portion 9B, the swinging guide portion 9B rotates by the sheet thickness about the swinging shaft 90 to retract in a −Z direction. Then, when the leading edge of the sheet S abuts against the abutment surface 74A of the shutter portion 7A to be restrained, the reaction force from the shutter portion 7A and the connecting portion 65 are transmitted to the upstream side in the sheet conveying direction X of the sheet S. When the reaction force is transmitted to the sheet S, a desired loop is formed, and the leading edge of the sheet S becomes parallel to the shaft direction of the first rotary shaft 63 of the conveying roller 61.

When the shutter portion 7A and the connecting portion 65 rotate about the first rotary shaft 63 of the conveying roller 61 in the state in which the sheet S is restrained at the abutment surface 74A of the shutter portion 7A, the swinging guide portion 9B retracts by the thickness of the sheet S in the –Z direction illustrated in FIG. 16A about the swinging shaft 90. When the shutter portion 7A rotates further, the sheet S is nipped by the nip portion of the conveying roller pairs 61 and 62 as illustrated in FIG. 16B, and the skew feed is corrected. In this embodiment, until the leading edge of the sheet S abuts against the abutment surface 74A of the shutter 7A and is nipped by the nip portion of the conveying roller pairs 61 and 62, the swinging guide portion 9B is always in the retracted state by pivoting by the paper thickness.

According to the laser beam printer 1B of the third embodiment having the above-mentioned configuration, the following effect is exhibited in addition to the effect obtained by the similar configuration in the first or second embodiment. The laser beam printer 1B according to the third embodiment has a configuration in which the swinging guide 9B pivots by the sheet thickness to retract. Therefore, for example, the leading edge position of the sheet S can be suppressed from an upstream side in the sheet conveying direction as compared to the first embodiment and the second embodiment. Accordingly, the recording precision of a sheet can be maintained in a sheet with a wider basis weight range than that of the first embodiment and the second embodiment, in particular, in a thin sheet with a small basis weight.

Further, for example, even in the case where there are a plurality of conveying paths for double-sided recording or in the case where the leading edge of the sheet S is curled, high skew feed correction ability can be obtained irrespective of the posture of the sheet S. Further, for example, even in the case where there are a plurality of postures of the leading edge of the sheet S when the leading edge of the sheet S strikes the abutment surface 74A of the shutter portion 7A as illustrated in FIG. 17, high skew feed correction ability can be obtained irrespective of the posture of the sheet S.

The embodiments of the present invention have been described above, but the present invention is not limited to the above-mentioned embodiments. Further, regarding the effects described in the embodiments of the present invention, the most preferred effects obtained from the present invention have been merely listed, and the effects of the present invention are not limited to those described in the embodiments of the present invention.

Figure 18:
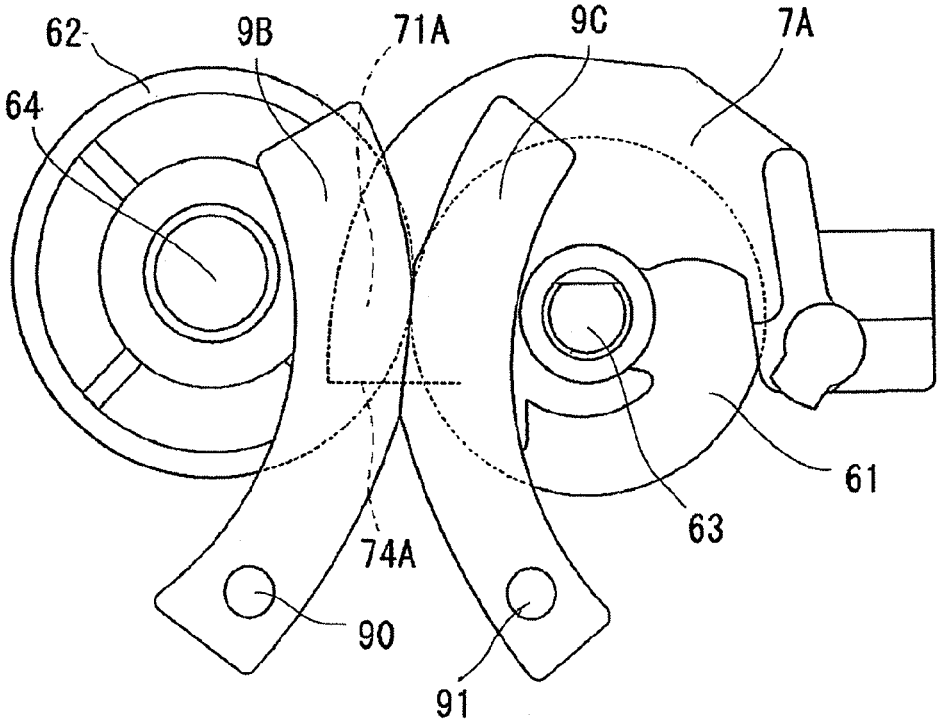
FIG. 18 is a view illustrating another embodiment of the skew feed correcting portion according to the third embodiment.

For example, in the third embodiment, one fixed guide portion 8B is used for one swinging guide portion 9B. However, this embodiment is not limited thereto. For example, as illustrated in FIG. 18, the swinging guide portion may be used instead of the fixed guide portion 8B. That is, two swinging guide portions may be used. Even in the configuration in which two swinging guides are used, the same effects as those in the third embodiment can be exhibited.

For example, in the embodiments of the present invention, the radius up to the regulating surface 72 of the same radius portion 70 of the shutter portion 7 or 7A is set to be substantially the same as the radius of the conveying roller 61. However, the invention is not limited thereto. For example, in the same radius portion 70, only the above-mentioned length in the vicinity of the base portion 73 of the abutment portion 71 needs to be substantially the same radius as that of the conveying roller 61. With this configuration, high skew feed correction ability can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-224330, filed Oct. 1, 2010, which is hereby incorporated by reference herein in its entirety.

What is claimed is:

1. A sheet conveying apparatus, comprising:

a conveying roller pair including a first conveying roller and a second conveying roller, which conveys a sheet by a nip portion formed by the first conveying roller and the second conveying roller;

a shutter portion which is rotated around a rotation center of a rotary shaft of the first conveying roller, the shutter portion being rotated and guiding a leading edge of the sheet to the nip portion after the leading edge of the sheet conveyed toward the nip portion abuts against the shutter portion;

an abutment portion, provided in the shutter portion, against which the leading edge of the sheet is abutted; and a guide portion disposed opposite to the shutter portion, the guide portion being coaxially adjacent to the second conveying roller and having an outer circumferential surface which is the same as a roller surface of the second conveying roller in the nip portion, the guide portion being fixed to the sheet conveying apparatus to guide the leading edge of the sheet to the nip portion when the shutter portion is rotated by abutting the leading edge of the sheet against the abutment portion.

2. A sheet conveying apparatus according to claim 1, wherein the abutment portion includes an abutment surface which is inclined so as to form an obtuse angle with respect to a nip tangent of the nip portion when the shutter portion rotates and the sheet reaches the nip portion.

3. An image forming apparatus, comprising:

a sheet conveying apparatus as recited in claim 1; and an image forming portion configured to form an image on a sheet fed from the sheet conveying apparatus.

4. An image forming apparatus according to claim 1, wherein the abutment portion includes an abutment surface which is inclined so as to form an acute angle with respect to a nip tangent of the nip portion when the shutter portion rotates and the sheet reaches the nip portion.

5. An image forming apparatus according to claim 3, wherein the abutment portion includes an abutment surface which is inclined so as to form an obtuse angle with respect to a nip tangent of the nip portion when the shutter portion rotates and the sheet reaches the nip portion.

6. A sheet conveying apparatus according to claim 1, wherein as viewed in a direction along an axis of the second conveying roller, a guide surface of the guide portion substantially coincides with an outer circumferential surface of the second conveying roller in a vicinity of the nip portion.

* * * * *